US008607413B2

(12) United States Patent
Carpinella et al.

(10) Patent No.: US 8,607,413 B2
(45) Date of Patent: Dec. 17, 2013

(54) FURNITURE GLIDE HAVING INTERCHANGEABLE BASE

(75) Inventors: Ralph Carpinella, Woodbury, CT (US); Robert Dombroski, Waterbury, CT (US); David Ferraro, Cheshire, CT (US)

(73) Assignee: Carpin Manufacturing, Inc., Waterbury, CT (US)

( * ) Notice: Subject to any disclaimer, the term of this patent is extended or adjusted under 35 U.S.C. 154(b) by 241 days.

(21) Appl. No.: 12/807,838

(22) Filed: Oct. 21, 2010

(65) Prior Publication Data

US 2012/0096680 A1 Apr. 26, 2012

(51) Int. Cl.
*A47B 91/06* (2006.01)

(52) U.S. Cl.
USPC ..... 16/42 T; 16/42 R

(58) Field of Classification Search
USPC ..... 16/42 R, 42 T; 248/188.8, 188.9, 188.3, 248/346.07
See application file for complete search history.

(56) References Cited

U.S. PATENT DOCUMENTS

| | | | | |
|---|---|---|---|---|
| 2,640,219 | A | 6/1953 | Becker | |
| 2,840,113 | A * | 6/1958 | Simpson et al. | 138/89 |
| 2,860,368 | A | 11/1958 | Thornsbury | |
| 3,025,557 | A | 3/1962 | Knowlton | |
| 3,183,545 | A * | 5/1965 | Bergstrom | 16/42 R |
| 3,389,421 | A * | 6/1968 | Wheeler | 16/42 R |
| 5,010,621 | A | 4/1991 | Bock | 16/39 |
| 5,782,444 | A * | 7/1998 | Anderman et al. | 248/188.8 |
| 5,991,974 | A | 11/1999 | Carpinella | 16/42 R |
| 6,154,923 | A | 12/2000 | Carpinella | 16/42 R |
| 6,405,982 | B2 * | 6/2002 | Ferencz | 248/188.9 |
| 6,626,405 | B1 | 9/2003 | Keast et al. | 248/188.9 |
| 6,869,052 | B2 * | 3/2005 | Keast et al. | 248/188.9 |
| 2002/0088082 | A1 | 7/2002 | Carpinella et al. | 16/42 R |
| 2005/0081330 | A1 * | 4/2005 | Edwards | 16/42 R |
| 2005/0172449 | A1 | 8/2005 | Carpinella | 16/42 R |
| 2005/0183234 | A1 * | 8/2005 | Bushey et al. | 16/42 R |
| 2006/0200938 | A1 | 9/2006 | Dombroski | 16/42 R |
| 2008/0209685 | A1 * | 9/2008 | Dombroski et al. | 16/42 R |
| 2009/0056071 | A1 | 3/2009 | Vorpahl | 16/45 |
| 2010/0018005 | A1 * | 1/2010 | Bushey | 16/42 T |
| 2010/0212113 | A1 | 8/2010 | Carpinella et al. | 16/42 T |
| 2010/0212114 | A1 | 8/2010 | Carpinella et al. | 16/42 T |
| 2011/0191985 | A1 * | 8/2011 | Hirth | 16/42 R |

FOREIGN PATENT DOCUMENTS

| | | | |
|---|---|---|---|
| DE | 102005042170 | * | 3/2007 |
| EP | 1224889 A1 | * | 7/2002 |
| FR | 2711900 A1 | * | 5/1995 |
| GB | 2052256 A | * | 1/1981 |

OTHER PUBLICATIONS

GB 1101011.3, Patents Act 1977 Search Report under Section 17, dated May 5, 2011.

* cited by examiner

*Primary Examiner* — Chuck Mah
(74) *Attorney, Agent, or Firm* — Alix, Yale & Ristas, LLP

(57) ABSTRACT

A furniture glide for use with a tubular furniture leg. The glide comprises a furniture leg engagement assembly adapted to be mounted to the furniture leg and a base assembly mounted to the furniture leg engagement assembly. The base assembly includes a receiver member and a base member removably mounted to the receiver member. The base member has a pad portion with a bottom surface adapted for contacting a floor.

27 Claims, 9 Drawing Sheets

FURNITURE GLIDE HAVING INTERCHANGEABLE BASE

BACKGROUND

The present invention relates to furniture glides, and more particularly to swiveling furniture glides for the leg of an article of furniture.

Furniture glides are well known for fixation to the leg of an article of furniture to protect the end portion of the leg from damage, and further, to protect a floor surface from damage as a result of the furniture leg.

The conventional furniture glide typically employs a plastic bottom surface for contact with the floor to allow sliding of the furniture on a floor surface without excessive gouging or scratching of that floor surface. Furthermore, the conventional furniture glide spreads the mass of the furniture and any additional mass, for example, a person sitting in a chair, over a larger surface area to prevent denting or impression into the floor surface. Some furniture glides further employ a swiveling mechanism to allow the bottom of the glide to rest flat on a floor surface for varying angles of the furniture leg. The swiveling mechanism compensates for slight variations in the lengths of the legs of furniture, variations in the flatness of the floor surface, and splay in the legs of the article of furniture.

In conventional furniture glides, the sliding surface for contacting the floor is of a material specifically chosen for surface on which the furniture glide will rest. Typical base element materials include steel (usually selected for carpeted floors), hard plastics such as nylon or polyethylene (typically selected for tile floors and older vinyl flooring products containing asbestos), or soft plastics (typically selected for vinyl flooring products that do not contain asbestos and wood floors). Accordingly, certain furniture may not be suitable for use in certain locations due to incompatibilities between the materials of the flooring of the location and the glide installed on the furniture. In addition, the sliding surfaces composed of soft materials are subject to wear.

SUMMARY

There is provided a furniture glide for use with a tubular furniture leg. The glide comprises a furniture leg engagement assembly adapted to be mounted to the furniture leg and a base assembly mounted to the furniture leg engagement assembly. The base assembly includes a receiver member and a base member removably mounted to the receiver member. The base member has a pad portion with a bottom surface adapted for contacting a floor.

The receiver member includes a downwardly extending circular outer ring and a downwardly extending axial structural element defining an annular cavity. The base member includes an inner ring and an outer ring extending upwardly from the pad portion, the inner and outer rings defining an annular cavity. The base member inner ring is received in the receiver member annular cavity and the receiver member outer ring is received in the base member annular cavity.

The base member inner ring may have an inner surface defining a recess and the receiver member axial structural element may include a radially extending protrusion that is received within the recess of the inner wall of the base member inner ring to mount the base member to the receiver member.

The base member outer ring may have an inner wall defining a recess and the receiver member outer ring may include a radially extending protrusion that is received within the recess of the inner wall of the base member outer ring to removably mount the base member to the receiver member.

The base member outer ring has at least one radially extending slot adapted to receive the tip of a tool to bias the base member away from the receiver member until the protrusion on the receiver member outer ring slides out of the recess of the inner wall of the base member outer ring or the protrusion on the receiver member axial structural element slides out of the recess of the inner wall of the base member inner ring to remove the base member.

The furniture glide further comprises a rivet mounting the base assembly to the furniture leg engagement assembly. The rivet has an upper head portion that engages the furniture leg engagement assembly, an opposite ball portion, and an elongated neck portion extending therebetween. The rivet ball portion has a substantially spherical outer swivel surface.

The receiver member may include an upwardly extending central pivot portion having a substantially concave swivel surface corresponding to the outer swivel surface of the rivet. The pivot portion of the receiver member pivot portion has a predetermined height whereby the pivot portion swivel surface of the receiver member is in congruent surface-to-surface contact with ball portion swivel surface of the rivet.

The base assembly may also include a cushion member composed of a resilient material. The cushion member has a lower segment received within a depression in the upper surface of the receiver member and an upwardly extending central pivot segment. The cushion member pivot segment has a substantially concave swivel surface corresponding to the outer swivel surface of the rivet and a predetermined height whereby the pivot portion swivel surface of the cushion member is in congruent surface-to-surface contact with ball portion swivel surface of the rivet.

The base member may be composed of a hard nylon material. The bottom surface of the base member pad portion may be connected to an outer wall of the base member pad portion by a curved surface. The outer wall of the base member pad portion may be substantially perpendicular to the bottom surface of the base member pad portion, defining a sharp outer edge. The bottom surface of the base member pad portion may have an axial recess with an inner wall that is substantially perpendicular to the bottom surface of the base member pad portion, defining a sharp inner edge.

The base member may be composed of a rubber material. The base member pad portion may have multiple blind bores extending downward from the upper surface of the base member pad portion to a position intermediate the upper surface of the base member pad portion and the bottom surface of the base member pad portion.

The base member may include an upper portion composed of a hard nylon material and a felt pad fixedly mounted to a bottom surface of the base member upper portion.

The base member may include an upper portion composed of a hard nylon material and a metal plate fixedly mounted to a bottom surface of the base member upper portion. The outer lip of the metal plate may be molded into the bottom surface of the base member upper portion.

The base assembly also includes an outer shell having a generally frustoconical shape defining an upper reduced portion and a lower expanded portion. The reduced portion has an outer shell opening for receiving the rivet neck portion. The expanded portion has a crimped outer edge. An inner shell is disposed within the outer shell. The inner shell has a substantially spherical shape and an inner surface in slidable engagement with the ball portion swivel surface of the rivet. The inner shell also has an inner shell opening for receiving the rivet neck portion.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

With reference to the drawings wherein like numerals represent like parts throughout the several figures, a furniture glide in accordance with the present disclosure is generally designated by the numeral 10.

Figure 1:
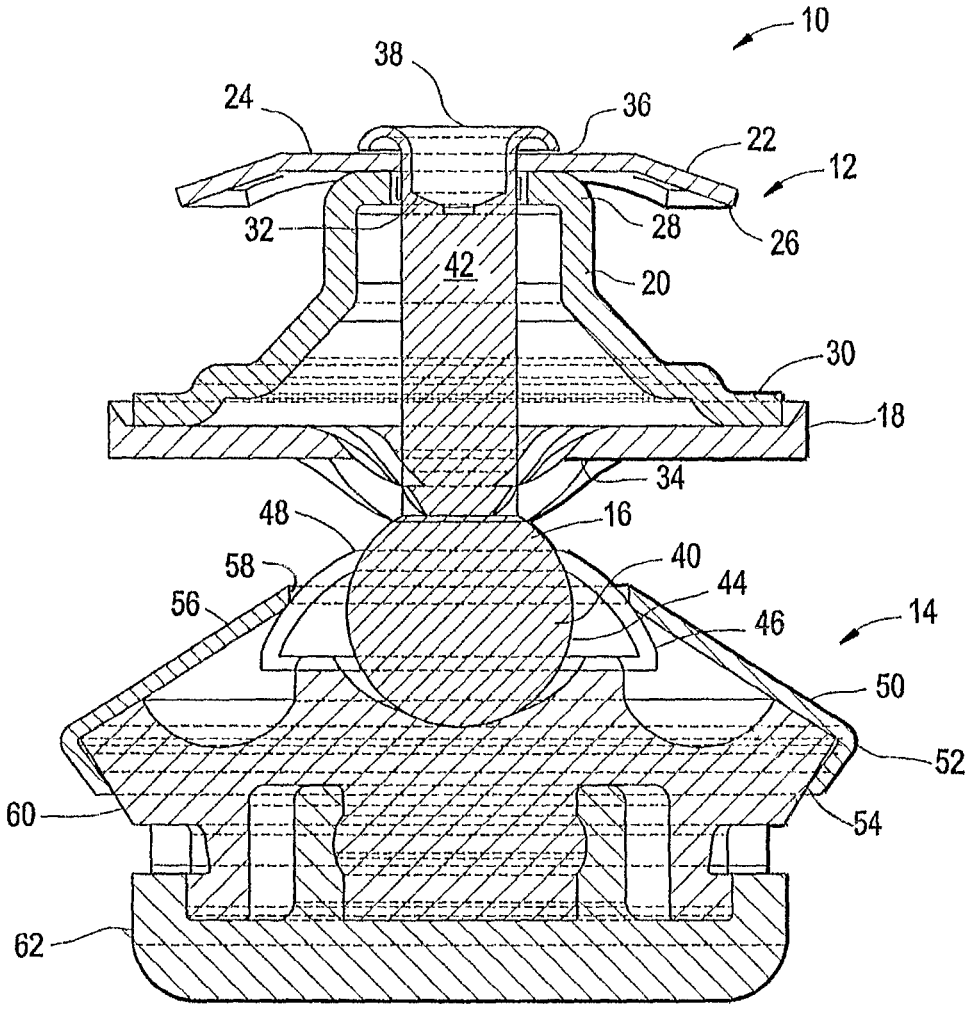
FIG. 1 is a lateral cross-sectional view of a furniture glide in accordance with the disclosure having a first embodiment of a base member.

With reference to FIG. 1, the furniture glide 10 includes a furniture leg engagement assembly 12, a base assembly 14 and a rivet 16 mounting the base assembly 14 to the furniture leg engagement assembly 12. The furniture leg engagement assembly 12 includes a base member 18, an extension member 20 and a clip 22. The clip 22 is formed from a resilient metal disk has a circular clip hub 24 and a plurality of clip arms 26 which extend radially outward and longitudinally downward from the clip hub 24. The clip 22 is supported by the upper end 28 of extension member 20 and the bottom surface of a radially extending lip 30 of the extension member 20 is supported by the upper surface of the base member 18. An axial bore 32 extending longitudinally through the extension member 20 is coaxial with a circular rivet opening 34 in the base member 18 and a circular rivet opening 36 in the clip 24.

The clip 22 and extension 20 member are inserted into the furniture leg until the bottom end of the furniture leg is fully seated against the upper surface of the extension member lip 30. The outside diameter defined by the clip arms 26 is selected such that it is slightly greater than the inside diameter of the tubular furniture leg. The clip arms 26 are resiliently deformable such that the end of the furniture leg engages the clip arms 26 and deforms the clip arms 26 radially inwardly to the smaller inside diameter of the furniture leg. The spring force of the clip arms 26 biases each clip arm 26 radially outward to frictionally engage the inner surface of the furniture leg to thereby mount the furniture glide 10 to the furniture leg.

The rivet 16 is secured through the clip rivet opening 36, the extension member bore 32, and the base rivet opening 34. The rivet 16 has an expandable head portion 38, an opposite ball portion 40, and an elongated neck portion 42 extending therebetween. The head portion 39 of the rivet 16 is inserted through the aligned base rivet opening 34, extension member bore 32, and clip rivet opening 36 and rounded or peened over to pull the ball portion 40 against the bottom surface of the base 18. The rivet securely fastens the base 18, extension member 20, and clip together 22. The ball portion 40 of the rivet 16 extends downward from the bottom surface to define a spherical outer swivel surface 44.

The base assembly 14 includes an inner shell 46 that slidably engages the outer swivel surface 44 of the rivet ball portion 40. The inner shell 46 is generally spherical and defines a circular inner shell opening 48 having a diameter less than the rivet swivel portion 40. The inner shell 46 is nested within an outer shell 50 having a generally frustoconical shape forming an expanded portion 52 defining an outer edge 54 and a reduced portion 56. The outer shell 50 defines a circular outer shell opening 58 at the reduced portion 56 having a diameter less than the outer diameter of the inner shell 46. The spherical shape of the inner shell 46 allows for improved swiveling sliding engagement of the inner shell 46 with the outer shell 50.

A receiver member 60 is fixedly mounted within the expanded portion 52 of the outer shell 50 and a base member 62 is removably mounted to the receiver member 60. The receiver member 60 may be molded as a unitary or singular component constructed of a hard wear-resistant plastic such as nylon. With reference to FIGS. 1, 2, 5 and 14, the receiver member 60, 60' is circular, having an annular rim portion 64 that is disposed within the crimped outer edge 54 of the outer shell 50 and thereby fixedly mounted to the outer shell 50.

The receiver member 60 includes a downwardly extending circular ring 66 and a downwardly extending axial structural element 68 that form an annular cavity 76 for receiving an upwardly extending inner ring 72 of the base member 62. An upwardly extending outer ring 74 of the base member 62 and the inner ring 72 of the base member 62 form an annular cavity 76 for receiving the receiver member ring 66. In the receiver member variations 60, 60" shown in FIGS. 2 and 14, the axial structural element 68 includes a radially extending protrusion 78 that is received within a corresponding recess 80 in the inner wall 82 of the inner ring 72 of the base member 62 to removably mount the base member 62 to the receiver member 60, 60". In the receiver member variation 60' shown in FIG. 5, the receiver member ring 66' includes a radially extending protrusion 84 that is received within a corresponding recess 86 in the inner wall 82' of the outer ring 74' of the base member 62' to removably mount the base member 62' to the receiver member 60'.

Figure 2:
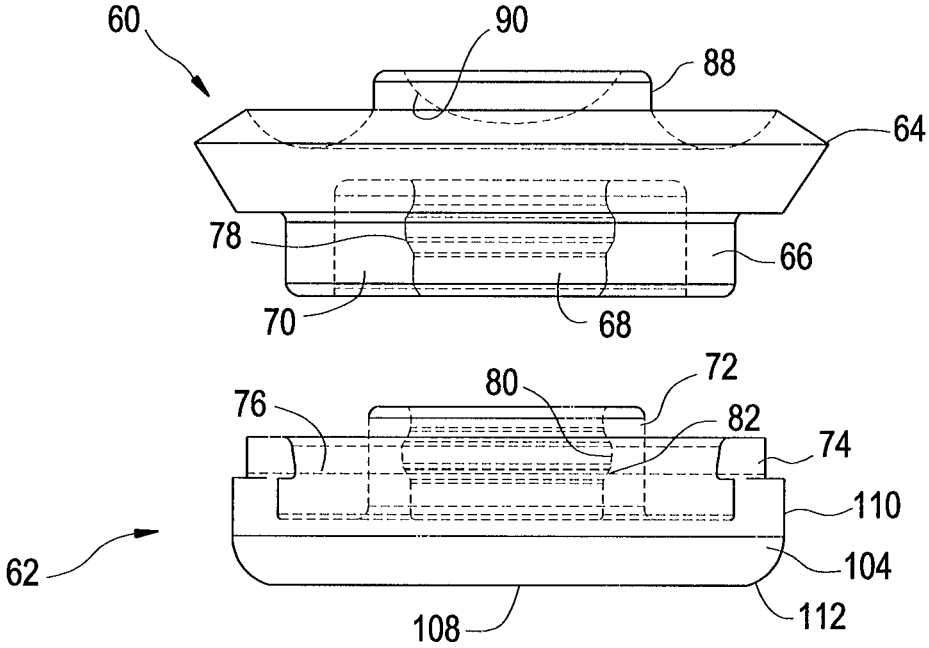
FIG. 2 is an enlarged, exploded cross-sectional view of the receiver member and base member of FIG. 1.
Figure 3:
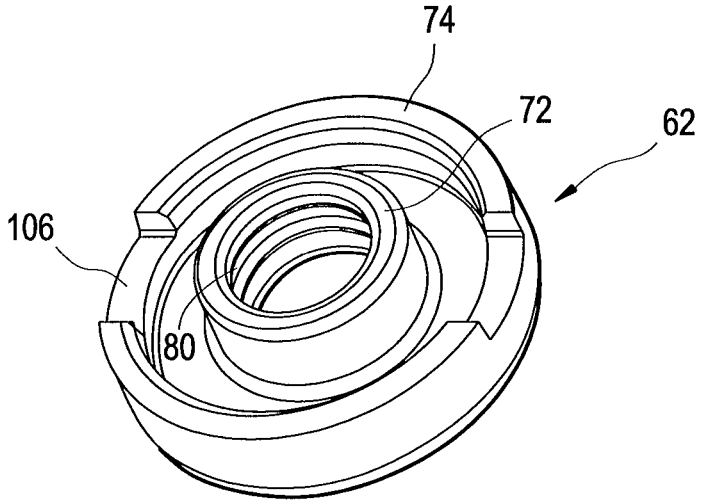
FIG. 3 is an enlarged perspective view of the base member of FIG. 1.
Figure 4:
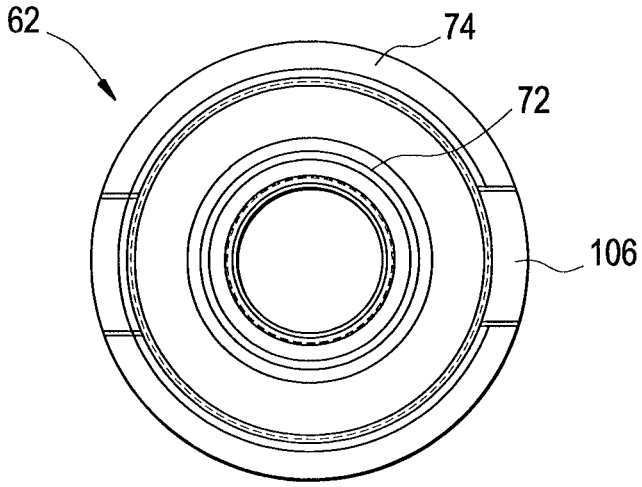
FIG. 4 is a top view of the base member of FIG. 3.
Figure 5:
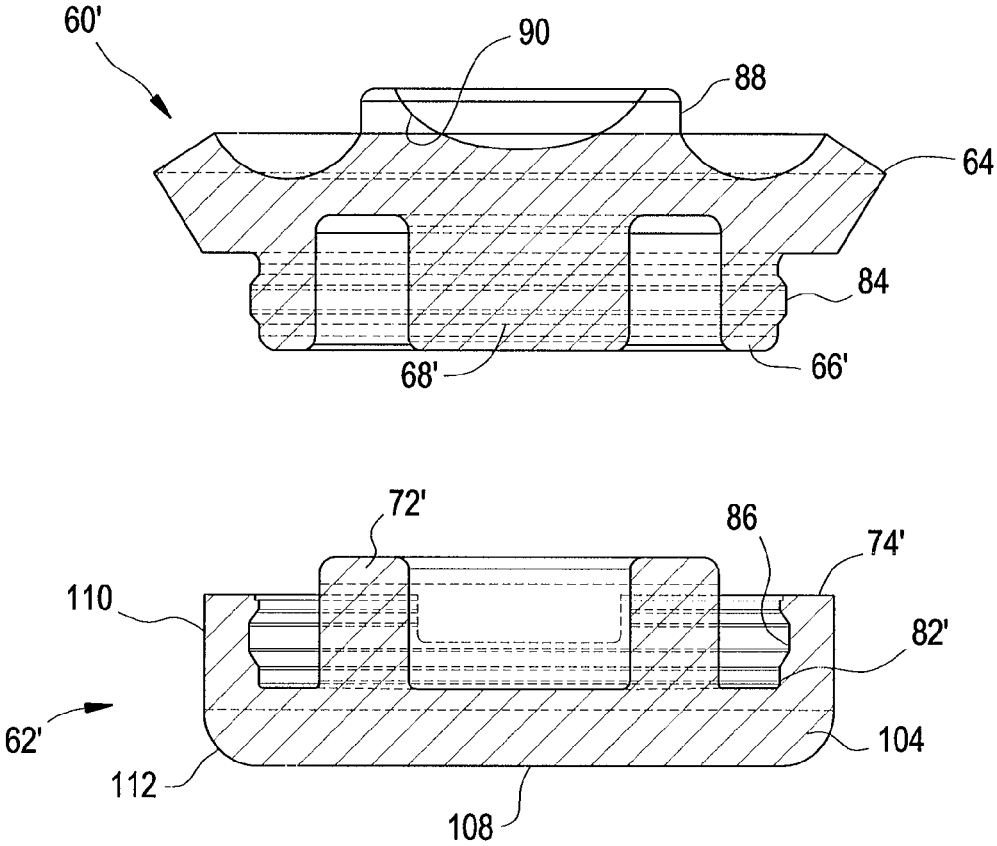
FIG. 5 is an exploded cross-sectional view of a variation of the receiver member and base member of FIG. 1.

In the receiver member variations 60, 60" shown in FIGS. 1, 2 and 5, the receiver member 60, 60" includes an upwardly extending central pivot portion 88 that defines a generally concave swivel surface 90 that is in congruent surface-to-surface contact with the spherical outer swivel surface 44 of the rivet 16. The pivot portion 88 has a sufficient height to maintain the base assembly 14 in tight engagement with the rivet ball portion 40. In the receiver member variation 60" shown in FIG. 14, the upper surface of the receiver member 60" defines a depression 94 for receiving the lower segment 96 of a cushion member 98. An upwardly extending central pivot segment 100 of the cushion member 98 defines a generally concave swivel surface 102 that is in congruent surface-to-surface contact with the spherical outer swivel surface 44 of the rivet 16. The pivot segment 100 has a sufficient height to maintain the base assembly 14 in tight engagement with the rivet ball portion 40. The cushion member 98 is composed of a resilient material, such as rubber, to absorb force applied on the base assembly 14 by the rivet 16.

The base members 62. 62', 162, 262, 362, 462 act as a cushion or a glide that can slide along a floor surface. As described above, each of the base members 62. 62', 162, 262, 362, 462 includes inner and outer rings 72, 74 that extend upwardly from a pad portion 104. The outer ring 74 of each base member 62. 62', 162, 262, 362, 462 defines one or more radially extending slot 106. The base member 62. 62', 162, 262, 362, 462 installed on the glide 10 may be removed by inserting the tip of a screw driver, or similar device, into the slot 106 and pushing the base member 62. 62', 162, 262, 362, 462 away from the receiver member 60, 60', 60" with the screw driver until the protrusion 78 on the receiver member axial structural element 68 slides out of the recess 80 on the base member inner ring 72 or the protrusion 84 on the receiver member ring 66' slides out of the recess 86 on the base member outer ring 74'. A replacement or new base member 62. 62', 162, 262, 362, 462 can then be installed by positioning the receiver member axial structural element 68, 68' in the center of the base member inner ring 72, 72' and pushing the base member 62. 62', 162, 262, 362, 462 and receiver member 60, 60' 60" together until the protrusion 78 on the receiver member axial structural element 68 slides into the recess 80 on the base member inner ring 72 or the protrusion 84 on the receiver member ring 66' slides into the recess 86 on the base member outer ring 74'.

Figure 6:
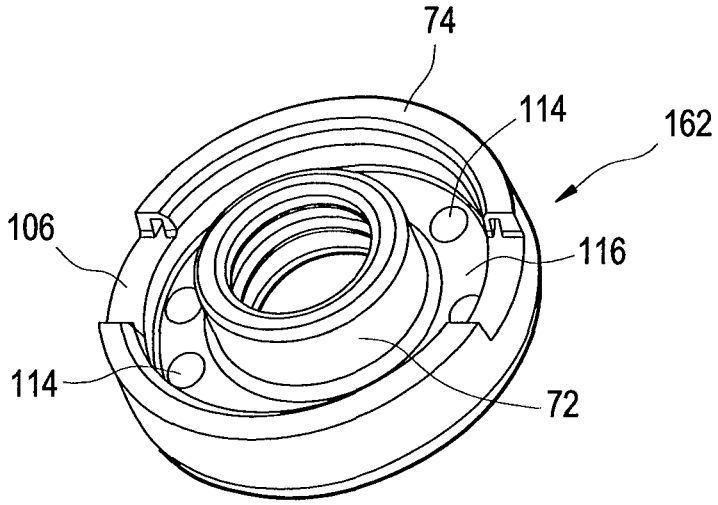
FIG. 6 is a top view of a second embodiment of a base member.
Figure 7:
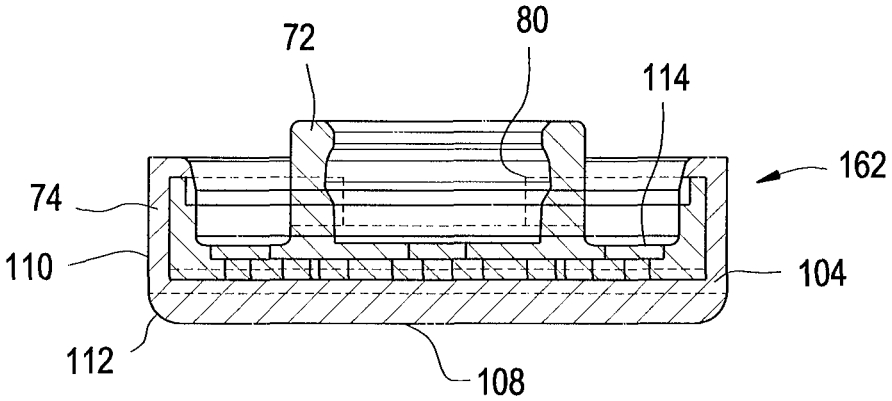
FIG. 7 is a cross-sectional view of the base member of FIG. 6.

The base members shown in FIGS. 1-9 may be molded as a unitary or singular component. The base member 62 shown in FIGS. 1-4 and the base member 62' shown in FIG. 5 are composed of a hard nylon material and the base member 162 of FIGS. 6 and 7 is composed of a rubber material. The pad portions 104 of the base members have a smooth sliding surface 108, for contacting a floor surface, that is connected to the pad portion outer wall 110 by curved surface 112. In the base member variation 162 of FIGS. 6 and 7, the pad portion 104 includes a number of blind bores 114 that extend downward from the upper surface 116 of the pad portion 104 to a position intermediate the upper surface 116 and the sliding surface 108. The blind bores 114 provide additional flexibility to the pad portion 104 which facilitates adhesion to the floor.

Figure 8:
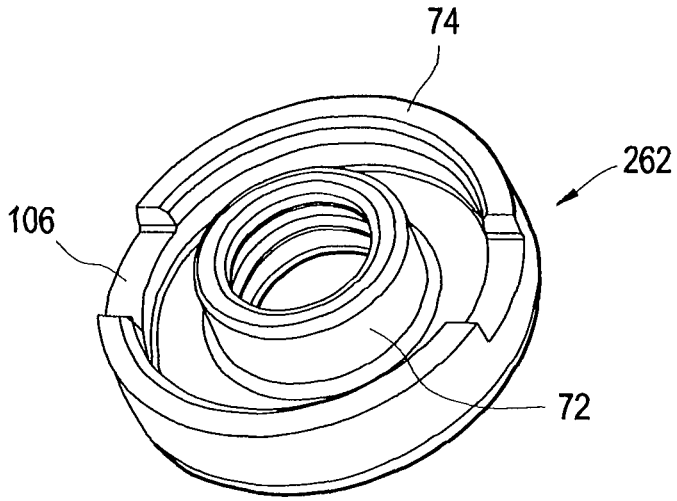
FIG. 8 is a top view of a third embodiment of a base member.
Figure 9:
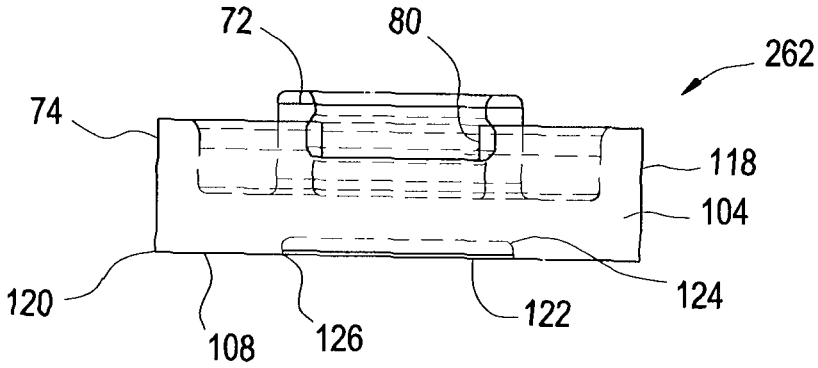
FIG. 9 is a cross-sectional view of the base member of FIG. 8.
Figure 10:
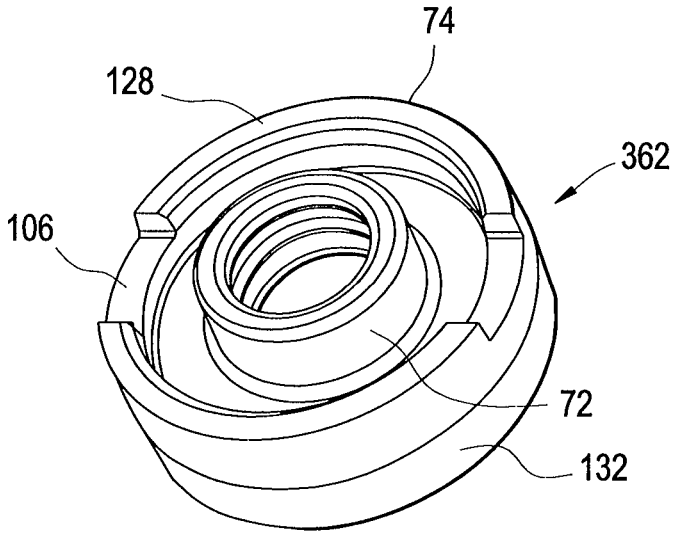
FIG. 10 is a top view of a fourth embodiment of a base member.
Figure 11:
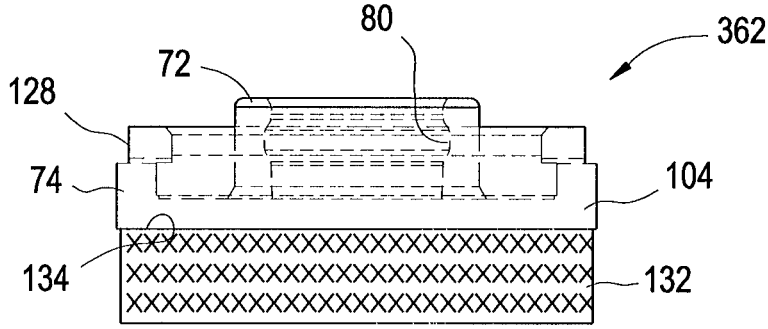
FIG. 11 is a cross-sectional view of the base member of FIG. 10.
Figure 12:
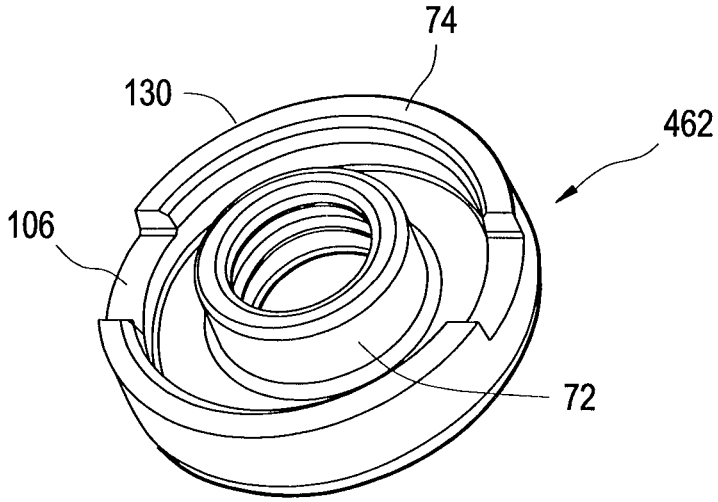
FIG. 12 is a top view of a fifth embodiment of a base member.

The base member 262 of FIGS. 8 and 9 is also composed of a hard nylon material. The outer wall 118 of the base member 262 is substantially perpendicular to the sliding surface 108', forming a sharp outer edge 120. The sharp outer edge 120 of the base member 262 acts as a plow when the furniture glide 10 is slid along the floor, for example when a chair having leg mounted furniture glides 10 is slid back from a table. More specifically, dirt or other debris is pushed out of the path of the furniture glide 10 as the furniture to which they are mounted are slid along the floor. The sharp outer edge 120 prevents such dirt or debris from sliding under the plow base. The sliding surface 108 may have an axial recess 122. The inner wall 124 of the base member 262 is substantially perpendicular to the sliding surface 108', forming a sharp inner edge 126. The sharp inner edge 126 of the base member 262 acts as a plow after the piece of furniture is initially placed on the floor or after the piece of furniture is moved by lifting it and setting it back down. Any dirt/debris that is disposed between the floor and the plow base will be plowed into recess 122 by the sharp inner edge 126, if the furniture is then slid along the floor.

Figure 13:
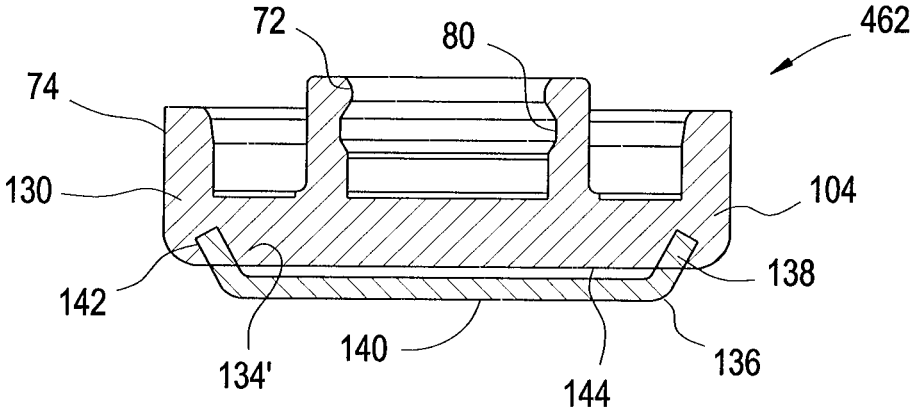
FIG. 13 is a cross-sectional view of the base member of FIG. 12.
Figure 14:
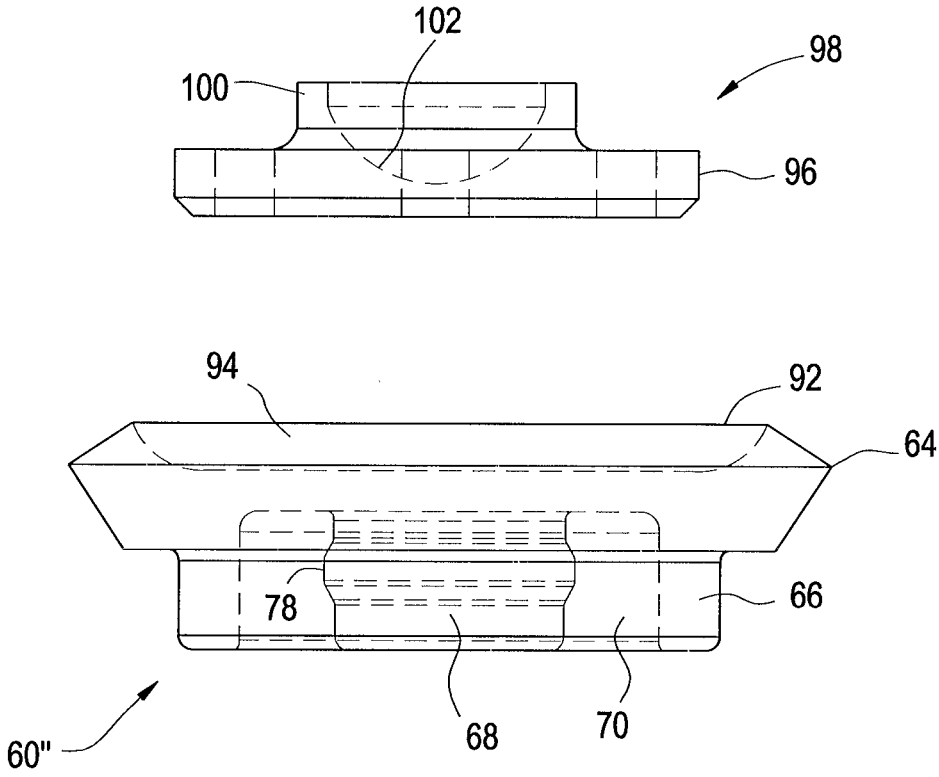
FIG. 14 is an exploded cross-sectional view of a variation of the receiver member of FIG. 1.

The upper portions 128, 130 of the base members 362, 462 shown in FIGS. 10-13 may also be molded as a unitary or singular component composed of a hard nylon material. In the variation 362 of FIGS. 10 and 11, a felt pad 132 is fixedly mounted to the bottom surface 134 of the base member pad portion 104. In the variation of FIGS. 23 and 13, a metal plate 136 is fixedly mounted to the bottom surface 134' of the base member pad portion 104. For example, the outer lip 138 of the metal plate 136 may be molded into the base member pad portion 104, extending upwardly into a slot 142 formed in the bottom surface 134' of the base member pad portion 104 during the molding process. Alternatively, the metal plate 136 may be mounted to the bottom surface 134' of the base member pad portion 104 by an adhesive 144.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A furniture glide for use with a tubular furniture leg, the glide comprising:

a furniture leg engagement assembly adapted to be mounted to the furniture leg; and a base assembly mounted to the furniture leg engagement assembly, the base assembly including:

a rivet mounting the base assembly to the furniture leg engagement assembly, the rivet having an upper head portion engaging the furniture leg engagement assembly, an opposite ball portion, and an elongated neck portion extending therebetween, the rivet ball portion having a substantially spherical outer swivel surface, a unitary receiver member having an upwardly extending central pivot portion having a substantially concave swivel surface corresponding to the outer swivel surface of the rivet, and a base member removably mounted to the receiver member, the base member having a pad portion with a bottom surface adapted for contacting a floor.

2. The furniture glide of claim 1 wherein the receiver member includes a downwardly extending circular outer ring and a downwardly extending axial structural element, the outer ring and the structural element defining an annular cavity, and the base member includes an inner ring and an outer ring extending upwardly from the pad portion, the inner and outer rings defining an annular cavity, the base member inner ring being received in the receiver member annular cavity and the receiver member outer ring being received in the base member annular cavity.

3. The furniture glide of claim 2 wherein the base member inner ring has an inner surface defining a recess and the receiver member axial structural element includes a radially extending protrusion that is received within the recess of the inner wall of the base member inner ring to mount the base member to the receiver member.

4. The furniture glide of claim 3 wherein the base member outer ring defines at least one radially extending slot adapted to receive the tip of a tool to bias the base member away from the receiver member until the protrusion on the receiver member axial structural element slides out of the recess of the inner wall of the base member inner ring to remove the base member.

5. The furniture glide of claim 2 wherein the base member outer ring has an inner wall defining a recess and the receiver member outer ring includes a radially extending protrusion that is received within the recess of the inner wall of the base member outer ring to removably mount the base member to the receiver member.

6. The furniture glide of claim 5 wherein the base member outer ring defines at least one radially extending slot adapted to receive the tip of a tool to bias the base member away from the receiver member until the protrusion on the receiver member outer ring slides out of the recess of the inner wall of the base member outer ring to remove the base member.

7. The furniture glide of claim 2 wherein the base member is a unitary component.

8. The furniture glide of claim 7 wherein the base member is composed of a hard nylon material.

9. The furniture glide of claim 8 wherein the base member pad portion bottom surface is connected to an outer wall of the base member pad portion by a curved surface.

10. The furniture glide of claim 8 wherein an outer wall of the base member pad portion is substantially perpendicular to the bottom surface of the base member pad portion, defining a sharp outer edge.

11. The furniture glide of claim 10 wherein the bottom surface of the base member pad portion defines an axial recess having an inner wall that is substantially perpendicular to the bottom surface of the base member pad portion, defining a sharp inner edge.

12. The furniture glide of claim 7 wherein the base member is composed of a rubber material.

13. The furniture glide of claim 12 wherein the base member pad portion defines a plurality of blind bores extending downward from an upper surface of the base member pad portion to a position intermediate the upper surface of the base member pad portion and the bottom surface of the base member pad portion.

14. The furniture glide of claim 2 wherein the base member pad portion includes:

an upper portion composed of a hard nylon material; and a felt pad fixedly mounted to a bottom surface of the base member upper portion.

15. The furniture glide of claim 2 wherein the base member pad portion includes:

an upper portion composed of a hard nylon material; and a metal plate fixedly mounted to a bottom surface of the base member upper portion.

16. The furniture glide of claim 15 wherein an outer lip of the metal plate is molded into the bottom surface of the base member upper portion.

17. The furniture glide of claim 1 wherein the receiver member pivot portion has a predetermined height whereby the pivot portion swivel surface of the receiver member is in congruent surface-to-surface contact with the ball portion swivel surface of the rivet.

18. The furniture glide of claim 1 wherein the base assembly also includes:

an outer shell having a generally frustoconical shape defining an upper reduced portion and a lower expanded portion, the reduced portion defining an outer shell opening for receiving the rivet neck portion, the expanded portion defining a crimped outer edge; and an inner shell disposed within the outer shell, the inner shell having a substantially spherical shape and defining an inner shell opening for receiving the rivet neck portion, the inner shell having an inner surface in slidable engagement with the ball portion swivel surface of the rivet.

19. The furniture glide of claim 18 wherein the receiver member is fixedly mounted within the expanded portion of the outer shell, the receiver member having an annular rim portion disposed within the crimped outer edge of the outer shell.

20. A furniture glide for use with a tubular furniture leg, the glide comprising:

a furniture leg engagement assembly adapted to be mounted to the furniture leg;

a base assembly mounted to the furniture leg engagement assembly, the base assembly including an outer shell having a generally frustoconical shape defining an upper reduced portion and a lower expanded portion, the expanded portion defining a crimped outer edge, and an inner shell disposed within the outer shell, the inner shell having a substantially spherical shape;

a unitary receiver member fixedly mounted within the expanded portion of the outer shell, the receiver member including an upwardly extending central pivot portion having a substantially concave swivel surface, and a base member removably mounted to the receiver member, the base member having a pad portion with a bottom surface adapted for contacting a floor; and a rivet mounting the base assembly to the furniture leg engagement assembly, the rivet having an upper head portion engaging the furniture leg engagement assembly, an opposite ball portion having a substantially spherical outer swivel surface in slidable engagement with the swivel surface of the receiver member pivot portion, and an elongated neck portion extending from the rivet upper head portion to the rivet ball portion through an opening in the base assembly outer shell and an opening in the base assembly inner shell.

21. The furniture glide of claim 20 wherein the receiver member includes a downwardly extending circular outer ring and a downwardly extending axial structural element, the outer ring and the structural element defining an annular cavity, and the base member includes an inner ring and an outer ring extending upwardly from the pad portion, the inner and outer rings defining an annular cavity, the base member inner ring being received in the receiver member annular cavity and the receiver member outer ring being received in the base member annular cavity.

22. The furniture glide of claim 21 wherein the base member outer ring defines at least one radially extending slot, the base member inner ring has an inner surface defining a recess, and the receiver member axial structural element includes a radially extending protrusion that is received within the recess of the inner wall of the base member inner ring to mount the base member to the receiver member, the slot in the base member outer ring being adapted to receive the tip of a tool to bias the base member away from the receiver member until the protrusion on the receiver member axial structural element slides out of the recess of the inner wall of the base member inner ring to remove the base member.

23. The furniture glide of claim 21 wherein the base member outer ring defines at least one radially extending slot, the base member outer ring has an inner wall defining a recess and the receiver member outer ring includes a radially extending protrusion that is received within the recess of the inner wall of the base member outer ring to removably mount the base member to the receiver member, the slot in the base member outer ring being adapted to receive the tip of a tool to bias the base member away from the receiver member until the protrusion on the receiver member axial structural element slides out of the recess of the inner wall of the base member inner ring to remove the base member.

24. The furniture glide of claim 20 wherein the receiver member pivot portion having a predetermined height whereby the pivot portion swivel surface of the receiver member is in congruent surface-to-surface contact with ball portion swivel surface of the rivet.

25. A furniture glide for use with a furniture leg, the glide comprising:

a furniture leg engagement assembly adapted to be mounted to the furniture leg; and a base assembly including:

a rivet mounting the base assembly to the furniture leg engagement assembly, the rivet having an upper head portion engaging the furniture leg engagement assembly, an opposite ball portion, and an elongated neck portion extending therebetween, the rivet ball portion having a substantially spherical outer swivel surface, a unitary receiver member mounted to the furniture leg engagement assembly, the receiver member having an upwardly extending central pivot portion having a substantially concave swivel surface corresponding to the outer swivel surface of the rivet, and an interchangeable base member removably mounted to the receiver member, the base member having a pad portion with a bottom surface adapted for contacting a floor.

26. The furniture glide of claim 25 wherein the base member pad portion comprises a material selected from metal, felt, rubber or nylon.

27. The furniture glide of claim 25 wherein the receiver member includes a downwardly extending circular outer defining a cavity, and the base member includes an inner ring extending upwardly from the pad portion, the base member inner ring being received in the receiver member cavity.

* * * * *